US011017943B2

(12) United States Patent
Wu et al.

(10) Patent No.: US 11,017,943 B2
(45) Date of Patent: May 25, 2021

(54) METHOD FOR PREPARING A PERMANENT MAGNET MATERIAL

(71) Applicant: Baotou Tianhe Magnetics Technology Co., Ltd., Baotou (CN)

(72) Inventors: Shujie Wu, Baotou (CN); Yi Dong, Baotou (CN); Shulin Diao, Baotou (CN); Shuai Zhang, Baotou (CN); Yi Yuan, Baotou (CN); Ya Chen, Baotou (CN); Wenjie Yuan, Baotou (CN)

(73) Assignee: Baotou Tianhe Magnetics Technology Co., Ltd.

( * ) Notice: Subject to any disclaimer, the term of this patent is extended or adjusted under 35 U.S.C. 154(b) by 486 days.

(21) Appl. No.: 15/842,039

(22) Filed: Dec. 14, 2017

(65) Prior Publication Data

US 2018/0226189 A1 Aug. 9, 2018

(30) Foreign Application Priority Data

Feb. 8, 2017 (CN) ..... 201710068324.2

(51) Int. Cl.

| | |
|---|---|
| ***H01F 41/02*** | (2006.01) |
| ***C25D 7/00*** | (2006.01) |
| ***C25D 3/66*** | (2006.01) |
| ***H01F 1/053*** | (2006.01) |
| ***C25D 5/50*** | (2006.01) |
| ***C25D 5/18*** | (2006.01) |
| *H01F 1/057* | (2006.01) |

(52) U.S. Cl.

CPC ..... *H01F 41/0266* (2013.01); *C25D 3/665* (2013.01); *C25D 5/18* (2013.01); *C25D 5/50* (2013.01); *C25D 7/001* (2013.01); *H01F 1/0536* (2013.01); *H01F 41/0293* (2013.01); *H01F 1/0577* (2013.01)

(58) Field of Classification Search

CPC . C25D 5/18; C25D 5/50; C25D 7/001; C25D 3/665; C25D 3/56; H01F 41/0266; H01F 41/0293; H01F 1/0536; H01F 1/0577

See application file for complete search history.

(56) References Cited

U.S. PATENT DOCUMENTS

| | | | | |
|---|---|---|---|---|
| 2005/0016858 | A1* | 1/2005 | Barstad | C25D 3/02 205/104 |
| 2010/0192814 | A1* | 8/2010 | Herzog | C04B 26/18 108/161 |
| 2013/0001092 | A1* | 1/2013 | Abbott | C07C 233/05 205/238 |
| 2017/0062127 | A1* | 3/2017 | Yi | B22F 3/24 |
| 2017/0335478 | A1* | 11/2017 | Chen | H01F 41/0293 |

FOREIGN PATENT DOCUMENTS

| | | | | |
|---|---|---|---|---|
| CN | 101404195 | A | 4/2009 | |
| CN | 101506919 | A | 8/2009 | |
| CN | 105185497 | A | * 12/2015 | B22F 3/24 |
| CN | 105648487 | A | 6/2016 | |
| CN | 105839152 | A | 8/2016 | |

OTHER PUBLICATIONS

Weil et al., "Electroplating Coatings", 1992, ASM International, vol. 18, pp. 834-839 (Year: 1992).*

* cited by examiner

*Primary Examiner* — Alexandra M Moore
*Assistant Examiner* — Adil A. Siddiqui
(74) *Attorney, Agent, or Firm* — Lerner, David, Littenberg, Krumholz & Mentlik, LLP

(57) ABSTRACT

The disclosure discloses a method for preparing a permanent magnet material. In this method, an ionic liquid electroplating process is used to electroplate a heavy rare earth metal onto a surface of a sintered magnet to form a magnet with a coating, wherein the sintered magnet has a thickness of 10 mm or less in at least one direction; in the ionic liquid electroplating process, an electroplating solution comprises an ionic liquid, a heavy rare earth salt, a group VIII metal salt, an alkali metal salt and an additive, an anode is a heavy rare earth metal or a heavy rare earth alloy, a cathode is the sintered magnet, an electroplating temperature is 20-50° C., an electroplating time is 15-80 min. The preparation method of the disclosure can improve an intrinsic coercive force of the magnet with low cost and high production efficiency. A utilization rate of heavy rare earth is high.

1 Claim, No Drawings

METHOD FOR PREPARING A PERMANENT MAGNET MATERIAL

CROSS-REFERENCE TO RELATED APPLICATIONS

The present application claims priority from Chinese Patent Application No. 201710068324.2 filed Feb. 8, 2017, the disclosure of which is hereby incorporated herein by reference.

TECHNICAL FIELD OF THE DISCLOSURE

This disclosure relates to a method for preparing a permanent magnet material, in particular to a method for preparing a permanent magnet material using an ionic liquid electroplating process.

BACKGROUND OF THE DISCLOSURE

As reducing energy consumption is concerned worldwidely, energy-saving and emission reduction has been focused by many countries. Compared with non-permanent magnet motors, permanent magnet motors can improve energy efficiency ratio. In order to reduce energy consumption, neodymium-iron-boron (Nd—Fe—B) permanent magnet material is used to produce motors in the air-conditioning compressors, electric vehicles, hybrid vehicles and other fields. Because these motors have a high operating temperature, a magnet with a high intrinsic coercive force (Hcj) is required. In order to increase the magnetic flux density of the motor, a magnet with a relatively high magnetic energy product (BH) is also required.

It is difficult to meet the demands of a high magnetic energy product and a high intrinsic coercive force through the traditional neodymium-iron-boron manufacturing process. Such a demand may be met by using a large amount of heavy rare earth metals. However, as the world's heavy rare earth metal reserves are limited, it will bring a magnet price rising and accelerate the depletion of heavy rare earth resources.

In order to improve a performance of permanent magnet materials and reduce the amount of heavy rare earth, a lot of work has been done. A very important direction of development is to improve a grain boundary through diffusion and penetration. Methods such as a surface-coating, a metal-vapor, a vapor-deposition and an electrodeposition have been developed.

CN101404195A disclosed a method for preparing a rare earth permanent magnet, comprising: providing a sintered magnet body consisting of 12-17 at % of rare earth, 3-15 at % of B, 0.01-11 at % of metal element, 0.1-4 at % of O, 0.05-3 at % of C, 0.01-1 at % of N, and the balance of Fe; disposing a powder comprising an oxide, fluoride and/or oxyfluoride of another rare earth on a surface of the magnet body; and heat treating the powder-covered magnet body at a temperature below the sintering temperature in vacuum or in an inert gas, so that the other rare earth is absorbed in the magnet body. In this method, substances harmful to magnet, such as O and F, are introduced. After the infiltration is finished, there will be a lot of substances which are similar to oxide surface on the surface of magnet. As a result, a grinding process is required and heavy rare earth metals are wasted. CN101506919A disclosed a process for producing a permanent magnet: in treatment chamber, Nd—Fe—B type sintered magnet and Dy are disposed with an interspace therebetween; subsequently, the treatment chamber is heated in vacuum so that a temperature of the sintered magnet increases to a given temperature and simultaneously Dy is evaporated. Evaporated Dy molecules are supplied and adhered to a surface of the sintered magnet; in this stage, a rate of Dy molecules supplied to the sintered magnet is controlled so that prior to formation of any Dy layer on the surface of the sintered magnet, Dy is uniformly diffused in a crystal grain boundary phase of the sintered magnet. In this method, the cost of equipments is high, the evaporation efficiency is low, and an increase in $H_{cj}$ is not obvious.

Electrodeposition is also an important method for formation of rare earth thin films on magnet surfaces. An ionic liquid has characteristics of small vapor pressure, good stability, good conductivity, "designability" and so on. It also has special solubility to many inorganic salts and organic substances. At present, the ionic liquid is mainly applied in the process of plating aluminum or zinc onto a surface of magnet so as to form a corrosion-resistant coating. There are few reports on applications of ionic liquids in electroplating heavy rare earth metals onto sintered magnet surfaces to improve magnetic properties. A main reason is that it is very difficult to select suitable and inexpensive ionic liquids to fully dissolve heavy rare earth salts and then select an appropriate plating condition to deposit a solution onto a magnet surface. Both CN105839152A and CN105648487A disclosed an electrodeposition method in which tetrafluoroborate, a bis-trifluoromethanesulfonimide salt and a bis-fluorosulfonylimide salt were used as ionic liquids in the electroplating. The abovementioned ionic liquids are relatively stable in the air, but have a limited solubility to inorganic metal salts. In addition, these ionic liquids are very expensive. If they are applied to electroplate magnets to improve magnetic properties, the production cost of magnets will increase a lot. Therefore, there is an urgent need for a method for improving magnetic properties of neodymium-iron-boron magnets with a lower production cost. Also, the method may result in a significant increase in an intrinsic coercive force and a relatively high magnetic energy product.

SUMMARY OF THE DISCLOSURE

An objective of this disclosure is to provide a method for preparing a permanent magnet material which can dramatically increase the intrinsic coercive force of neodymium-iron-boron magnets with a saved production cost. A further objective of this disclosure is to provide a method for preparing a permanent magnet material in which a magnetic energy product of the obtained magnet is relatively high. Another further objective of this disclosure is to provide a method for preparing a permanent magnet material in which a utilization rate of heavy rare earth metals is high, production efficiency is high, and a processing condition is mild. Thus, it is more suitable for industrial production.

A method for preparing a permanent magnet material of the disclosure comprises the following steps:

S1) magnet preparation step: preparing a R—Fe—B-M type sintered magnet, wherein R is one or more elements selected from the group consisted of Nd, Pr, Dy, Tb, Ho and Gd, a content of R is 24 wt %-35 wt % of the total weight of the sintered magnet; M is one or more elements selected from the group consisted of Ti, V, Cr, Mn, Co, Ni, Ga, Ca, Cu, Zn, Si, Al, Mg, Zr, Nb, Hf, Ta, W and Mo, a content of M is 0 wt %-5 wt % of the total weight of the sintered magnet; a content of B is 0.5 wt %-1.5 wt % of the total weight of the sintered magnet; the balance is Fe;

S2) ionic liquid electroplating step: electroplating a heavy rare earth metal onto a surface of the sintered magnet by using an ionic liquid electroplating process to form a magnet with a coating, wherein the sintered magnet has a thickness of 10 mm or less in at least one direction; in the ionic liquid electroplating process, an electroplating solution comprises an ionic liquid, a heavy rare earth salt, a group VIII metal salt, an alkali metal salt and an additive, an anode is heavy rare earth metal or heavy rare earth alloy, a cathode is the sintered magnet, a electroplating temperature is 20-50° C., a electroplating time is 15-80 min;

S3) diffusion step: heat treating the magnet with the coating, so as to diffuse the heavy rare earth metal into the sintered magnet; and S4) aging treatment step: aging treating the magnet obtained from the diffusion step S3);

wherein the ionic liquid is a compound having the following structure:

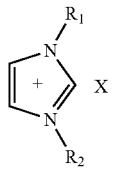

where $R_1$ and $R_2$ are independently selected from C1-C8 alkyl, respectively, X is selected from the group consisted of $Cl^-$, $CF_3SO_3^-$ or $N(CN)_2^-$;

wherein the additive is selected from the group consisted of ethylene glycol, urea, aromatic compounds or halogenated alkanes.

In accordance to the method of the disclosure, preferably, $R_1$ and $R_2$ are independently selected from C1-C4 alkyl, respectively; X is selected from $CF_3SO_3^-$ or $N(CN)_2^-$.

In accordance to the method of the disclosure, preferably, the ionic liquid is selected from the group consisted of 1-butyl-3-methylimidazolium chloride, 1-butyl-3-ethylimidazolium chloride, 1,3-dimethylimidazolium chloride, 1-hexyl-3-methylimidazolium chloride, 1-octyl-3-methylimidazolium chloride, 1-butyl-3-methylimidazole trifluoromethanesulfonate, 1-butyl-3-ethylimidazole trifluoromethanesulfonate, 1,3-dimethylimidazole trifluoromethanesulfonate, 1-hexyl-3-methylimidazole trifluoromethanesulfonate, 1-octyl-3-methylimidazole trifluoromethanesulfonate, 1-butyl-3-methylimidazole dicyandiamide salt, 1-butyl-3-ethylimidazole dicyandiamide salt, 1,3-dimethylimidazole dicyandiamide salt, 1-hexyl-3-methylimidazole dicyandiamide salt or 1-octyl-3-methylimidazole dicyandiamide salt.

In accordance to the method of the disclosure, preferably, in the electroplating solution, a heavy rare earth element of the heavy rare earth salt is selected from the group consisted of Gd, Tb, Dy or Ho; the group VIII metal of the group VIII metal salts is selected from the group consisted of Fe, Co or Ni; the alkali metal of the alkali metal salts is selected from the group consisted of Li, Na or K; the additive is an aromatic compound; in the anode, the heavy rare earth metal is selected from the group consisted of Gd, Tb, Dy or Ho, the heavy rare earth alloy is selected from alloys formed of the heavy rare earth metal and Fe.

In accordance to the method of the disclosure, preferably, in the electroplating solution, the heavy rare earth salt is a chloride, nitrate or sulfate of the heavy rare earth element; the group VIII metal salt is a chloride of a group VIII metal; the alkali metal salt is a chloride of an alkali metal; and the aromatic compound is one or more selected from the group consisted of benzene, toluene, xylene, ethylbenzene; in the anode, the heavy rare earth metal is Tb; the heavy rare earth alloy is an alloy formed of Tb and Fe.

In accordance to the method of the disclosure, preferably, a mole ratio of the sum of the heavy rare earth salt and the group VIII metal salt to the ionic liquid is 0.25-3:1; a mole ratio of the heavy rare earth salt to the group VIII metal salt is 0.25-10:1; in the electroplating solution, a concentration of an alkali metal salt is 10-200 g/L; a volume ratio of the additive to the ionic liquid is 10 vol %-400 vol %.

In accordance to the method of the disclosure, preferably, performing the ionic liquid electroplating step S2) in an anhydrous anaerobic condition by using one way as follows:

(1) a constant current electroplating with a current density of 5-20 $mA/cm^2$;

(2) a pulse voltage electroplating with an average pulse voltage of 5-8V, a duty cycle of 20%-50%, and a pulse frequency of 2-5 kHz.

In accordance to the method of the disclosure, preferably, the method further comprises an electroplating solution preparation step: mixing the heavy rare earth salt, the group VIII metal salt and the ionic liquid until homogeneous under an anhydrous anaerobic condition at a temperature of 80° C. or lower, then adding the alkali metal salt and the additive, and then mixing until homogeneous to obtain the electroplating solution.

In accordance to the method of the disclosure, preferably, in the diffusion step S3), a heat treatment temperature is 850-1,000° C., and a heat treatment time is 3-8 hours; and in the aging treatment step S4), a treatment temperature is 400-650° C., and a treatment time is 2-5 hours.

In accordance to the method of the disclosure, preferably, the magnet preparation step S1) comprising steps as follows:

S1-1) a smelting step: smelting a raw magnet material to form an alloy sheet with a thickness of 0.01-2 mm;

S1-2) a powdering step: subjecting the alloy sheet to a hydrogen absorption and dehydrogenation treatment in a hydrogen decrepitation furnace to form a coarse magnetic powder having an average particle size D50 of 200-350 μm, and then the coarse magnetic powder is crushed in an air jet mill to obtain a fine magnetic powder having an average particle size D50 of 2-20 μm;

S1-3) a shaping step: pressing the fine magnetic powder to make a green body under the actions of an alignment magnetic field; and S1-4) a sintering and cutting step: sintering the green body, and then cutting it into the sintered magnet; a sintering temperature is 960-1,100° C.; the sintered magnet has an oxygen content of less than 2,000 ppm.

The ionic liquid used in the method of the disclosure has a good solubility to inorganic metal salts and a relatively low price. The heavy rare earth metal can be deposited onto the surface of NdFeB magnets by controlling process conditions. The heavy rare earth metal are melted and diffused into the intergranular phase by a heat treatment; and then a permanent magnet material with an excellent intrinsic coercive force and an outstanding magnetic energy product can be obtained by an aging treatment. The present preparation method of the disclosure has high production efficiency, a high utilization rate of heavy rare earths, and a mild process condition. It is very suitable for industrial production.

DETAILED DESCRIPTION OF THE EMBODIMENTS

The disclosure will be further explained in combination with the following specific embodiments, but the protection scope of the invention is not limited thereto.

The "average particle size D50" in this disclosure represents the equivalent diameter of the largest particles when the cumulative distribution in the particle size distribution curve is 50%.

The "vacuum degree" in this disclosure means absolute vacuum degree. Accordingly, a smaller value of absolute vacuum degree represents a higher vacuum degree.

The preparation method of the disclosure comprises S1) magnet preparation step, S2) ionic liquid electroplating step, S3) diffusion step and S4) aging treatment step, which will be described separately in the following text.

<Magnet Preparation Step>

The magnet preparation step S1) of the disclosure may comprise steps as follows:

S1-1) a smelting step: smelting a raw magnet material to form an alloy sheet with a thickness of 0.01-2 mm;

S1-2) a powdering step: the alloy sheet is subjected to a hydrogen absorption and dehydrogenation treatment in a hydrogen decrepitation furnace to form a coarse magnetic powder having an average particle size D50 of 200-350 μm, and then the coarse magnetic powder is crushed in an air jet mill to obtain a fine magnetic powder having an average particle size D50 of 2-20 μm;

S1-3) a shaping step: pressing the fine magnetic powder to make a green body under the actions of an alignment magnetic field; and S1-4) a sintering and cutting step: sintering the green body, and then cutting it into a sintered magnet wherein a sintering temperature is 960-1,100° C. and the sintered magnet has an oxygen content of less than 2,000 ppm.

In the smelting step S1-1) of the disclosure, the raw magnet material includes R, Fe, B and M. R is one or more elements selected from the group consisted of Nd, Pr, Dy, Tb, Ho and Gd; preferably, R is selected from the group consisted of Nd, Pr or Dy; more preferably, R is Nd. A content of R is 24 wt %-35 wt % of the total weight of the sintered magnet, preferably 25 wt %-33 wt %, more preferably 28 wt %-32 wt %. M is one or more elements selected from the group consisted of Ti, V, Cr, Mn, Co, Ni, Ga, Ca, Cu, Zn, Si, Al, Mg, Zr, Nb, Hf, Ta, W and Mo; preferably, M is one or more elements selected from the group consisted of Mn, Co, Ni, Ga, Ca, Cu, Zn, Al and Zr. A content of M is 0 wt %-5 wt % of the total weight of the sintered magnet, preferably 0.05 wt %-3 wt %. A content of B is 0.5 wt %-1.5 wt % of the total weight of the sintered magnet, preferably 0.5 wt %-1 wt %. The balance of the raw magnet material is Fe.

The smelting step S1-1) of the disclosure is carried out in vacuum or inert atmosphere, so that oxidation of the magnet raw material (such as neodymium-iron-boron magnet raw materials) and the alloy sheet prepared therefrom may be prevented. The smelting process may utilize a casting process or a strip casting process. The casting process is that cooling and solidifying a smelted magnet raw material and producing an alloy ingot. The strip casting process is that rapidly cooling and solidifying a smelted magnet raw material and spinning into an alloy sheet. For instance, for the neodymium-iron-boron magnet raw materials, compared with the casting process, the strip casting process can avoid an occurrence of α-Fe which may affect uniformity of a magnetic powder, and it can avoid an emergence of agglomerated rich-neodymium phase, which is conducive to refinement of $Nd_2Fe_{14}B$ grains in the main phase. Therefore, the smelting process of the disclosure preferably is strip casting process. The strip casting process is normally carried out in a vacuum smelting strip casting furnace. The alloy sheet of the disclosure may have a thickness of 0.01-2 mm, preferably 0.05-1 mm, more preferably 0.2-0.35 mm.

The powdering process S1-2) of the disclosure is carried out in vacuum or inert atmosphere, so that oxidation of the alloy sheet and the magnetic powder can be prevented. The alloy sheet is subjected to a hydrogen absorption and dehydrogenation treatment in a hydrogen decrepitation furnace to form a coarse magnetic powder having an average particle size D50 of 200-350 μm. The average particle size D50 of the coarse magnetic powder is preferably 230-300 μm. The hydrogen decrepitation process comprises steps as follows: firstly the alloy sheet is subjected to hydrogen absorption, a volume expansion of the alloy sheet lattice caused by a reaction of the alloy sheet with hydrogen makes the alloy sheet crush into a coarse magnetic powder, and then the coarse magnetic powder is heated for dehydrogenation. In accordance to one embodiment of the disclosure, in the hydrogen decrepitation process, a hydrogen absorption temperature is 20° C.-400° C., preferably 100° C.-300° C.; a hydrogen absorption pressure is 50-600 kPa, preferably 100-500 kPa; a dehydrogenation temperature is 400° C.-1,000° C., preferably 500° C.-600° C. The coarse magnetic powder is crushed into a fine magnetic powder having an average particle size D50 of 2-20 μm in an air jet mill. The fine magnetic powder preferably has an average particle size D50 of 3-10 μm. The jet milling process is a process to make the coarse magnetic powder accelerated by a gas flow so as to hit each other and then be crushed. The gas flow may be a nitrogen flow, preferably a high purity nitrogen flow. The high purity nitrogen flow may have a $N_2$ content of 99.0 wt % or more, preferably 99.9 wt % or more. A pressure of the gas flow may be 0.1-2.0 MPa, preferably 0.5-1.0 MPa, more preferably 0.6-0.7 MPa.

The shaping step S1-3) of the disclosure is carried out in vacuum or inert atmosphere, so that oxidation of the magnetic powder can be prevented. The magnetic powder pressing process may utilize a mould pressing process and/or an isostatic pressing process. The mould pressing process and the isostatic pressing process may be those known in the art, and they will not be described here. The fine magnetic powder is pressed to make a green body under an alignment magnetic field. The direction of alignment magnetic field is parallel or perpendicular to the pressing direction of the magnetic powder. In accordance to one embodiment of the disclosure, the alignment magnetic field has a strength of 1-5 Tesla (T), preferably 1.5-3 T, more preferably 1.6-1.8 T. The green body obtained from the above shaping step S1-3) may have a density of 3.5 $g/cm^3$-5.0 $g/cm^3$, preferably 3.8 $g/cm^3$-4.4 $g/cm^3$.

The sintering process in the sintering and cutting step S1-4) of the disclosure is also carried out in vacuum or inert atmosphere, so that oxidation of the green body can be prevented. The sintering process may be performed in a vacuum sintering furnace. A sintering temperature may be 960-1,100° C., preferably 1,050-1,060° C. A sintering time may be 3-10 hours, preferably 5-6 hours. A density of sintered magnet obtained from the above sintering process may be 6.5 $g/cm^3$-8.9 $g/cm^3$, preferably 7.3 $g/cm^3$-7.9 $g/cm^3$; an oxygen content is preferably less than 2,000 ppm, most preferably less than 1,200 ppm. The sintered green body obtained from the above sintering process may be cut with a slicing process and/or a wire cut electrical discharge machining and/or a diamond cutting process. The sintered green body is cut into a sintered magnet having a thickness of 10 mm or less in at least one direction, preferably 4 mm or less. As is preferred, the direction, in which the thickness is 10 mm or less, preferably 4 mm or less, is not an alignment direction of the sintered magnet.

The R—Fe—B-M type sintered magnet is obtained using the above process, with R, Fe, B and M are defined as previously stated, which is not repeated here.

<Ionic Liquid Electroplating Step>

The ionic liquid electroplating step S2) of the disclosure utilizes ionic liquid electroplating to electroplate heavy rare earth metals onto a surface of the sintered magnet, so as to form a magnet with a coating. The sintered magnet has a thickness of 10 mm or less in at least one direction. The direction in which the thickness is 10 mm or less is preferably not an alignment direction of the sintered magnet.

In the ionic liquid electroplating process of the disclosure, a solution comprising an ionic liquid, a heavy rare earth salt, a group VIII metal salt, an alkali metal salt and an additive is used as an electroplating solution, a heavy rare earth metal or a heavy rare earth alloy is used as an anode, the above-mentioned sintered magnet is used as an cathode. The present application found that an electroplating effect can be significantly improved when an electroplating temperature is controlled to be within a range of 20-50° C., preferably 30-35° C., and a electroplating time is controlled to be within a range of 15-80 min, preferably 30-60 min. Therefore, an ionic liquid with a low price may significantly improve an intrinsic coercive force and a magnetic energy product of a magnet. In the disclosure, the electroplating condition is mild, an electroplating time is suitable, and thus production efficiency can be improved.

In the disclosure, the ionic liquid is kept in an anhydrous anaerobic environment to prevent electroplating solution invalidation or an electrochemical window change of the electroplating solution caused by residual moisture and oxygen.

The ionic liquid of the disclosure is a compound having the following structure:

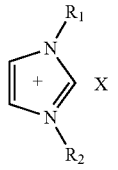

where $R_1$ and $R_2$ are independently selected from C1-C8 alkyl, respectively; X is selected from the group consisted of $Cl^-$, $CF_3SO_3^-$ or $N(CN)_2^-$. Preferably, $R_1$ and $R_2$ are independently selected from C1-C4 alkyl, respectively, X is selected from the group consisted of $CF_3SO_3^-$ or $N(CN)_2^-$. Examples of $R_1$ and $R_2$ include but not limited to methyl, ethyl, propyl, butyl, pentyl, hexyl, heptyl, octyl and the like. As is preferred, the ionic liquid is selected from the group consisted of 1-butyl-3-methylimidazolium chloride, 1-butyl-3-ethylimidazolium chloride, 1,3-dimethylimidazolium chloride, 1-hexyl-3-methylimidazolium chloride, 1-octyl-3-methylimidazolium chloride, 1-butyl-3-methylimidazole trifluoromethanesulfonate, 1-butyl-3-ethylimidazole trifluoromethanesulfonate, 1,3-dimethylimidazole trifluoromethanesulfonate, 1-hexyl-3-methylimidazole trifluoromethanesulfonate, 1-octyl-3-methylimidazole trifluoromethanesulfonate, 1-butyl-3-methylimidazole dicyandiamide salt, 1-butyl-3-ethylimidazole dicyandiamide salt, 1,3-dimethylimidazole dicyandiamide salt, 1-hexyl-3-methylimidazole dicyandiamide salt or 1-octyl-3-methylimidazole dicyandiamide salt. As is more preferred, the ionic liquid is selected from the group consisted of 1-butyl-3-methylimidazolium chloride, 1-butyl-3-ethylimidazolium chloride, 1-butyl-3-methylimidazole trifluoromethanesulfonate, 1-butyl-3-ethylimidazole trifluoromethanesulfonate, 1-butyl-3-methylimidazole dicyandiamide salt, 1-butyl-3-ethylimidazole dicyandiamide salt, 1,3-dimethylimidazole dicyandiamide salt, 1-hexyl-3-methylimidazole dicyandiamide salt or 1-octyl-3-methylimidazole dicyandiamide salt. In accordance to one embodiment of the disclosure, the ionic liquid is 1-butyl-3-methylimidazolium chloride or 1-butyl-3-methylimidazole trifluoromethanesulfonate.

The present application surprisingly found that, comparing with an ionic liquid such as tetrafluoroborate, a bistrifluoromethanesulfonimide salt and a bisfluorosulfonylimide salt, the abovementioned ionic liquid of the disclosure has a better solubility to inorganic metal salts and a relatively much lowered price, while they can electroplate a thin coating of heavy rare earth metal on a surface of a magnet within a very short time period under very mild conditions, so as to improve an intrinsic coercive force of the magnet.

In the electroplating solution of the disclosure, the heavy rare earth salt is a chloride, nitrate or sulfate of the heavy rare earth element. The heavy rare earth element of the heavy rare earth salt is selected form the group consisted of Gd, Tb, Dy or Ho, preferably is Tb or Dy. An example of the heavy rare earth salt includes but not limited to dysprosium chloride, terbium chloride, dysprosium nitrate or terbium nitrate and the like.

In the electroplating solution of the disclosure, the group VIII metal salt may be a chloride of a group VIII metal. The group VIII metal of the group VIII metal salt may be selected from the group consisted of Fe, Co or Ni; preferably is Fe or Ni. An example of the group VIII metal salt includes but not limited to ferric chloride, cobalt chloride or nickel chloride.

In the electroplating solution of the disclosure, the alkali metal salt may be a chloride of an alkali metal. The alkali metal of the alkali metal salt may be selected from the group consisted of Li, Na or K; preferably is Na or K. An example of the alkali metal salt includes but not limited to sodium chloride, potassium chloride and the like.

The electroplating solution of the disclosure further comprises an additive which is selected from the group consisted of ethylene glycol (EG), urea, aromatic compounds or halogenated alkanes; preferably is aromatic compounds. The aromatic compounds may be one or more selected from the group consisted of benzene, toluene, xylene and ethylbenzene; preferably is benzene or toluene. An example of the halogenated alkanes includes but not limited to monochloromethane, dichloromethane or chloroform and the like. The present application found that addition of the above additive, especially an aromatic compound, may improve the solubility, viscosity, conductive property of the ionic liquid. Accordingly, the electroplating time reduces, and the production efficiency increases.

In the electroplating solution of the disclosure, the ratio of the sum (in the unit of mole) of the amount of the heavy rare earth salt and the amount of group VIII metal salt to the amount of the ionic liquid (in the unit of mole) may be 0.25-3:1; preferably 0.5-2:1. The ratio of the amount of the heavy rare earth salt (in the unit of mole) to the amount of group VIII metal salt (in the unit of mole) is 0.25-10:1; preferably 0.5-9:1. Using the electroplating solution as a standard, a concentration of the alkali metal salt is 10-200 g/L; preferably is 30-60 g/L. A volume ratio of the additive to the ionic liquid may be 10 vol %-400 vol %; preferably, 30 vol %-50 vol %. Controlling the above parameters to be within the above range can further improve an electroplating effect, and accordingly improve the intrinsic coercive force and the magnetic energy product of the magnet.

In the anode of the disclosure, the heavy rare earth metal may be selected from the group consisted of Gd, Tb, Dy or Ho, preferably Tb or Dy. The heavy rare earth alloy may be selected from alloys formed of the heavy rare earth metal and Fe. The cathode of the disclosure is the sintered magnet to be electroplated which is obtained from the magnet preparation step S1) as described previously, it is not repeated here.

In order to improve the electroplating effect, the ionic liquid electroplating step S2) had better be performed under an anhydrous anaerobic condition. A constant current electroplating may be used for the ionic liquid electroplating step. A current density is 5-20 mA/cm$^2$; preferably 10-16 mA/cm$^2$. A pulse voltage electroplating may also be used for the ionic liquid electroplating step S2). An average value of a pulse voltage is 5-8V. A duty cycle is 20%-50%. A pulse frequency is 2-5 kHz. In accordance to one embodiment of the disclosure, the average value of the pulse voltage is 6-8V; the duty cycle is 30%-50%; the pulse frequency is 3-5 kHz. An electroplating temperature of the disclosure is a temperature of the ionic liquid, which may be 20-50° C., preferably 30-35° C. To prevent invalidation of the electroplating solution, a glove box may be used to seal an entire electroplating tank and then a protection gas (nitrogen or argon) is charged.

In order to improve an electroplating effect, the ionic liquid electroplating step S2) of the disclosure may comprise a pre-treatment step of the sintered magnet which is to be electroplated, a post-treatment step of the sintered magnet which is electroplated and the like. For example, steps such as degreasing→rust cleaning→activation→drying are used to clean and activate surfaces of the sintered magnet; a solvent such as anhydrous ethanol, acetone, haloalkane, benzene is used to clean surfaces of the magnet after electroplating. These are common steps in the field, and will not be repeated here.

<Diffusion Step>

The diffusion step S3) of the disclosure is a heat treatment of the magnet with the coating for allowing the heavy rare earth metal to diffuse into the sintered magnet. The diffusion of the disclosure comprises a diffusion process of the heavy rare earth metal from a surface of the sintered magnet into the sintered magnet, as well as a diffusion process of the heavy rare earth metal inside the sintered magnet. The heavy rare earth metal deposited on the surface of the sintered magnet may diffuse into the intergranular phase in the sintered magnet by the heat treatment. A heat treatment temperature may be 850-1,000° C., preferably 900-950° C. A heat treatment time is 3-8 hours, preferably 3.5-5 hours. Controlling the temperature and time of the heat treatment to be within the above ranges may further improve the intrinsic coercive force and the magnetic energy product of the sintered magnet.

The diffusion step S3) of the disclosure is performed in vacuum or inert atmosphere. In this way, oxidation of the surface of the sintered magnet can be prevented during the heat treatment. The oxidized surface of the magnet will prevent a continuous infiltration and diffusion of the heavy rare earth element. An absolute vacuum degree of the diffusion step S3) may be 0.000001-0.1 Pa, preferably 0.00001-0.01 Pa.

<Aging Treatment Step>

The aging treatment step S4) of the disclosure is aging treating the magnet obtained from the diffusion step S3). A treatment temperature is 400-650° C., preferably 500-550° C. A treatment time is 2-5 hours, preferably 3-5 hours. Controlling the temperature and time of the heat treatment to be within the above ranges may further improve the intrinsic coercive force and the magnetic energy product of the sintered magnet. In order to prevent oxidation of the sintered magnet, the aging treatment step S4) is carried out in vacuum or inert atmosphere. An absolute vacuum degree of the aging treatment step S4) may be 0.000001-0.1 Pa, preferably 0.00001-0.01 Pa.

Examples 1-2 and Comparative Example 1

S1) Magnet Preparation Step:

S1-1) smelting step: formulated a raw magnet material with weight percents of as follows: 23.5% of Nd, 5.5% of Pr, 2% of Dy, 1% of B, 1% of Co, 0.1% of Cu, 0.08% of Zr, 0.1% of Ga, and the balance of Fe; put the raw magnet material in a vacuum melting casting furnace to smelt and form an alloy sheet having an average thickness of 0.3 mm;

S1-2) powdering step: the alloy sheet was subjected to a hydrogen absorption and dehydrogenation treatment in a hydrogen decrepitation furnace, so as to allow the alloy sheet to form a coarse magnetic powder with a D50 of 300 μm, and then the coarse magnetic powder was crushed in an air jet mill using nitrogen as a medium to obtain a fine magnetic powder having a D50 of 4.2 μm;

S1-3) shaping step: applied an alighting magnetic field of 1.8 T to the fine magnetic powder under a protection of nitrogen in a forming presser, and pressed the powder to make a green body, wherein a density of the green body is 4.3 g/cm$^3$;

S1-4) sintering and cutting step: placed the green body in a vacuum furnace with an absolute vacuum degree above 0.1 Pa, and sintered under a temperature of 1,050° C. for 5 hours to obtain a magnet with a density of 7.6 g/cm$^3$, and a dimension of 50 mm×40 mm×30 mm; cut this magnet into a sintered magnet having a dimension of 38 mm×23.5 mm×4 mm;

S2) Ionic Liquid Electroplating Step:

The sintered magnet was subjected to degreasing→rust cleaning→acid cleaning activation→drying treatment, and the sintered magnet to be electroplated was obtained for further use.

In a glove box protected by nitrogen, anhydrous terbium chloride, anhydrous cobalt chloride and 1-butyl-3-methylimidazole chloride (ionic liquid) in a molar ratio of 1:0.5:1 was stirred uniformly at a temperature of less than 80° C., and then sodium chloride was added at a concentration of 30 g/L (based on the electroplating solution), followed by an addition of benzene having a volume ratio of 30 vol % to the ionic liquid, and the mixture was uniformly stirred to form an electroplating solution.

A constant current method was used for electroplating. An entire electroplating tank was sealed with the glove box and charged with nitrogen. A Tb metal block was used as an anode. The sintered magnet to be electroplated was used as a cathode. An anode current density was 16 mA/cm$^2$. A temperature of the ionic liquid was 35° C. The electroplating was carried out for 10 min (comparative example 1), 30 min and 60 min, respectively. The electroplated magnet was immediately rinsed with absolute ethanol and then dried.

S3) Diffusion step: when an absolute vacuum degree was above 0.01 Pa, the magnet with a Tb coating obtained from the ionic liquid electroplating step S2) was subjected to a heat treatment at 900° C. for 5 hours.

S4) Aging treatment step: when an absolute vacuum degree was above 0.01 Pa, the magnet obtained from the diffusion step S3) was subjected to a heat treatment at 500° C. for 3 hours. The obtained magnet was cut into a magnet with a dimension of 9 mm×9 mm×4 mm, and measured. The results are showed in Table 1.

TABLE 1

| | Conditions | Remanence $B_r$ (T) | Maximum magnetic energy product $(BH)_{max}$ (kJ/m$^3$) | Intrinsic coercive force $H_{cj}$ (kA/m) |
|---|---|---|---|---|
| Comparative example 1 | 10 min | 1.385 | 364.97 | 1670.38 |
| Example 1 | 30 min | 1.380 | 364.49 | 1969.74 |
| Example 2 | 60 min | 1.379 | 364.57 | 1992.03 |

It can be seen from Table 1, the ionic liquid electroplating time affects the remanence, the maximum magnetic energy product and the intrinsic coercive force. After the electroplating time exceeds 10 min, the intrinsic coercive force increases as the time increases, but it will not increase significantly after the electroplating time increases to a certain extent.

Examples 3-6 and Comparative Example 2

S1) Magnet Preparation Step:

S1-1) smelting step: formulated a raw magnet material with weight percents of as follows: 22.3% of Nd, 6.4% of Pr, 3% of Dy, 1% of B, 2% of Co, 0.2% of Cu, 0.08% of Zr, 0.15% of Ga, and the balance of Fe; put the raw magnet material in a vacuum melting casting furnace to smelt and form an alloy sheet having an average thickness of 0.3 mm;

S1-2) powdering step: the alloy sheet was subjected to a hydrogen absorption and dehydrogenation treatment in a hydrogen decrepitation furnace so as to allow the alloy sheet to form a coarse magnetic powder with a D50 of 300 μm, and then the coarse magnetic powder was crushed in an air jet mill using nitrogen as a medium to obtain a fine magnetic powder having a D50 of 3.8 μm;

S1-3) shaping step: applied an alighting magnetic field of 1.8 T to the fine magnetic powder under a protection of nitrogen in a forming presser, and pressed the powder to make a green body, wherein a density of the green body is 4.3 g/cm$^3$;

S1-4) sintering step: placed the green body in a vacuum furnace with an absolute vacuum degree above 0.1 Pa, and sintered under a temperature of 1,055° C. for 5 hours to obtain the magnet with a density of 7.62 g/cm$^3$, and a dimension of 50 mm×40 mm×30 mm; cut this magnet into a sintered magnet having a dimension of 38 mm×23.5 mm×2 mm;

S2) Ionic Liquid Electroplating Step:

The sintered magnet was subjected to degreasing→rust cleaning→acid cleaning activation→drying treatment, and the sintered magnet to be electroplated was obtained for further use.

In a glove box protected by nitrogen, anhydrous dysprosium chloride, anhydrous nickel chloride and 1-butyl-3-methylimidazole trifluoromethanesulfonate (ionic liquid) in a molar ratio of 1.5:0.5:1 at a temperature of less than 80° C. was stirred uniformly, and then potassium chloride was added at a concentration of 30 g/L (based on the electroplating solution), followed by an addition of toluene having a volume ratio of 50 vol % to the ionic liquid, and the mixture was uniformly stirred to form an electroplating solution.

A constant current method was used for electroplating. An entire electroplating tank was sealed with the glove box and charged with nitrogen. A Dy metal block was used as the anode. The sintered magnet to be electroplated was a cathode. An anode current density was 15 mA/cm$^2$. A temperature of the ionic liquid was 35° C. The electroplating was performed for 30 min. The electroplated magnet was immediately rinsed with toluene and then cleaned with absolute ethanol, and then dried.

S3) Diffusion step: when an absolute vacuum degree was above 0.01 Pa, the magnet with a Dy coating obtained from the ionic liquid electroplating step S2) was subjected to a heat treatment for 5 hours at different temperatures of 850° C., 900° C., 950° C. and 1,000° C., respectively.

S4) Aging treatment step: when an absolute vacuum degree was above 0.01 Pa, the magnet obtained from the diffusion step S3) was subjected to a heat treatment at 510° C. for 3 hours. The obtained magnet was cut into a magnet with a dimension of 9 mm×9 mm×2 mm, and measured. The results are showed in Table 2.

For the sake of comparison, the sintered magnet obtained from the magnet preparation step S1) did not go through the ionic liquid electroplating step S2) and the diffusion step S3), but directly went to the abovementioned aging treatment step S4). Then the obtained magnet was cut into a magnet with a dimension of 9 mm×9 mm×2 mm, and measured as comparative example 2. The results are showed in Table 2.

TABLE 2

| | Conditions | $B_r$ (T) | $(BH)_{max}$ (kJ/m$^3$) | $H_{cj}$ (kA/m) |
|---|---|---|---|---|
| Comparative example 2 | — | 1.342 | 341.72 | 1717.36 |
| Example 3 | 850° C. | 1.345 | 341.56 | 2060.51 |
| Example 4 | 900° C. | 1.340 | 341.08 | 2134.55 |
| Example 5 | 950° C. | 1.335 | 339.57 | 2114.65 |
| Example 6 | 1,000° C. | 1.332 | 336.31 | 1955.41 |

It can be seen from Table 2, the heat treatment temperature of the diffusion step S3) affects the remanence, the maximum magnetic energy product and intrinsic coercive force of neodymium-iron-boron permanent magnet. A lower or higher heat treatment temperature cannot achieve a significant increase of the above parameters.

Examples 7-9 and Comparative Example 3

S1) Magnet Preparation Step:

S1-1) smelting step: formulated a raw magnet material with weight percents of as follows: 27.4% of Nd, 4.5% of Dy, 0.97% of B, 2% of Co, 0.2% of Cu, 0.08% of Zr, 0.2% of Ga, 0.3% of Al, and the balance of Fe; put the raw magnet material in a vacuum melting casting furnace to smelt and form an alloy sheet having an average thickness of 0.3 mm;

S1-2) powdering step: the alloy sheet was subjected to a hydrogen absorption and dehydrogenation treatment in a hydrogen decrepitation furnace so as to allow the alloy sheet to form a coarse magnetic powder with a D50 of 300 μm, and then the coarse magnetic powder was crushed in an air jet mill using nitrogen as a medium to obtain a fine magnetic powder having a D50 of 3.8 μm;

S1-3) shaping step: applied an alighting magnetic field of 1.8 T to the fine magnetic powder under a protection of nitrogen in a forming presser, and pressed the powder to make a green body, wherein a density of the green body is 4.3 g/cm$^3$;

S1-4) sintering and cutting step: placed the green body in a vacuum furnace with an absolute vacuum degree above 0.1 Pa, and sintered under a temperature of 1,055° C. for 5 hours to obtain the magnet with a density of 7.63 g/cm$^3$, and a dimension of 50 mm×40 mm×30 mm; cut this magnet into a sintered magnet having a dimension of 38 mm×23.5 mm×2.2 mm;

S2) Ionic Liquid Electroplating Step:

The sintered magnet was subjected to degreasing→rust cleaning→acid cleaning activation→drying treatment, and the sintered magnet to be electroplated was obtained for further use.

In a glove box protected by nitrogen, anhydrous terbium chloride, anhydrous ferric chloride and 1-butyl-3-methylimidazole trifluoromethanesulfonate (ionic liquid) in a molar ratio of 1:1:1 was stirred uniformly at a temperature of less than 80° C., and then lithium chloride was added at a concentration of 40 g/L (based on the electroplating solution), followed by an addition of toluene having a volume ratio of 30 vol % to the ionic liquid, and the mixture was uniformly stirred to form an electroplating solution.

A pulse voltage electroplating was used for electroplating. An entire electroplating tank was sealed with the glove box and charged with nitrogen. An alloy block of Tb and Fe was used as the anode, wherein the alloy block has 75% of Tb by mass. The abovementioned sintered magnet to be electroplated was used as a cathode. An average value of the pulse voltage is 7V. A pulse frequency is 3.0 kHz. A duty cycle is 40%. A temperature of the ionic liquid is 20° C., 35° C. and 50° C., respectively. The electroplating was performed for 30 min. The electroplated magnet was immediately rinsed with absolute ethanol, and then dried.

S3) Diffusion step: when an absolute vacuum degree was above 0.01 Pa, the magnet with a Tb coating obtained from the ionic liquid electroplating step S2) was subjected to a heat treatment at temperature of 925° C. for 5 hours.

S4) Aging treatment step: when an absolute vacuum degree was above 0.01 Pa, the magnet obtained from the diffusion step S3) was subjected to a heat treatment at 510° C. for 3 hours. The obtained magnet was cut into a magnet with a dimension of 9 mm×9 mm×2 mm, and measured. The results are showed in Table 3.

For the sake of comparison, the sintered magnet obtained from the magnet preparation step S1) did not go through the ionic liquid electroplating step S2) and the diffusion step S3), but directly went to the abovementioned aging treatment step S4). Then the obtained magnet was cut into a magnet with a dimension of 9 mm×9 mm×2 mm, and measured as comparative example 3. The results of the measurements are showed in Table 3.

TABLE 3

| | Conditions | $B_r$ (T) | $(BH)_{max}$ (kJ/m$^3$) | $H_{cj}$ (kA/m) |
|---|---|---|---|---|
| Comparative example 3 | — | 1.295 | 320.38 | 2024.68 |
| Example 7 | 20° C. | 1.292 | 317.60 | 2416.40 |
| Example 8 | 35° C. | 1.288 | 315.13 | 2601.91 |
| Example 9 | 50° C. | 1.291 | 316.48 | 2487.26 |

It can be seen from Table 3, comparing examples 7-9 with comparative example 3, the remanence and the maximum magnetic energy product decrease slightly, while the intrinsic coercive force increases significantly. The electroplating temperature affects the remanence, the maximum magnetic energy product and the intrinsic coercive force of the magnet, wherein the effect on the intrinsic coercive force is most obvious.

The disclosure is not limited by the above embodiments. All variations, modifications and replacements which can be perceived by those skilled in the art and do not depart from the essence of the disclosure fall in the scope of the disclosure.

What is claimed is:

1. A method for preparing a permanent magnet material, comprising steps as follows:

S1) magnet preparation step:

S1-1) smelting step: formulating a raw magnet material consisting of the following components with weight percent: 27.4% of Nd, 4.5% of Dy, 0.97% of B, 2% of Co, 0.2% of Cu, 0.08% of Zr, 0.2% of Ga, 0.3% of Al, and the balance of Fe; putting the raw magnet material in a vacuum melting casting furnace to smelt and form an alloy sheet having an average thickness of 0.3 mm;

S1-2) powdering step: subjecting the alloy sheet to a hydrogen absorption and dehydrogenation treatment in a hydrogen decrepitation furnace so as to allow the alloy sheet to form a coarse magnetic powder with a D50 of 300 μm, and then crushing the coarse magnetic powder in an air jet mill using nitrogen as a medium to obtain a fine magnetic powder having a D50 of 3.8 μm;

S1-3) shaping step: applying an aligning magnetic field of 1.8 T to the fine magnetic powder under a protection of nitrogen in a forming presser, and pressing the fine magnetic powder to make a green body, wherein a density of the green body is 4.3 g/cm$^3$;

S1-4) sintering and cutting step: placing the green body in a vacuum furnace with an absolute vacuum degree above 0.1 Pa, and sintering the green body under a temperature of 1,055° C. for 5 hours to obtain a magnet with a density of 7.63 g/cm$^3$ and a dimension of 50 mm×40 mm×30 mm; cutting this magnet into a sintered magnet having a dimension of 38 mm×23.5 mm×2.2 mm;

S2) ionic liquid electroplating step:

subjecting the sintered magnet to degreasing, rust cleaning, acid cleaning activation and drying treatment to obtain the sintered magnet to be electroplated;

uniformly stirring anhydrous terbium chloride, anhydrous ferric chloride and 1-butyl-3-methylimidazole trifluoromethanesulfonate as ionic liquid with a molar ratio of 1:1:1 at a temperature of less than 80° C. in a glove box protected by nitrogen, adding lithium chloride with a concentration of 40 g/L based on an electroplating solution, adding toluene with a volume ratio of 30 vol % of 1-butyl-3-methylimidazole trifluoromethanesulfonate, and then stirring the mixture uniformly to form the electroplating solution;

sealing an entire electroplating tank with the glove box, charging the entire electroplating tank with nitrogen, electroplating the sintered magnet to be electroplated at a temperature of 35° C. for 30 min to obtain a electroplated magnet, and immediately rinsing the electroplated magnet with absolute ethanol, and then drying; wherein an alloy block of Tb and Fe having 75% of Tb by mass is used as the anode, the sintered magnet to be electroplated is used as a cathode, an average value of the pulse voltage is 7 V, a pulse frequency is 3.0 kHz, and a duty cycle is 40%;

S3) diffusion step: subjecting the magnet with a Tb coating obtained from the ionic liquid electroplating step S2) to a heat treatment at a temperature of 925° C. and an absolute vacuum degree above 0.01 Pa for 5 hours;

S4) aging treatment step: subjecting the magnet obtained from the diffusion step S3) to a heat treatment at a temperature of 510 Pa for 3 hours.

* * * * *